US009375078B2

(12) United States Patent
Doerflinger et al.

(10) Patent No.: US 9,375,078 B2
(45) Date of Patent: Jun. 28, 2016

(54) ROLL CAB STABILITY DEVICE

(71) Applicant: Snap-on Incorporated, Kenosha, WI (US)

(72) Inventors: David A Doerflinger, Racine, WI (US); Todd M Stevenson, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 14/531,288

(22) Filed: Nov. 3, 2014

(65) Prior Publication Data

US 2015/0130337 A1 May 14, 2015

Related U.S. Application Data

(60) Provisional application No. 61/904,019, filed on Nov. 14, 2013.

(51) Int. Cl.
*A47B 46/00* (2006.01)
*A47B 31/00* (2006.01)
*A47B 97/00* (2006.01)

(52) U.S. Cl.
CPC ..... *A47B 31/00* (2013.01); *A47B 2097/008* (2013.01)

(58) Field of Classification Search
CPC ..... A47B 96/06; A47B 96/00; A47B 88/04; A47B 2097/008
See application file for complete search history.

(56) References Cited

U.S. PATENT DOCUMENTS 2,607,649 A 8/1952 Johnson
2,854,785 A 10/1958 Sperlich
2,857,229 A 10/1958 Sitler
3,048,420 A * 8/1962 Martin ..... B62B 3/12 16/18 CG
3,150,904 A 9/1964 Kendt
3,150,905 A 9/1964 Payton
3,691,590 A * 9/1972 Drabert ..... B60B 33/00 16/18 CG
3,730,547 A 5/1973 Young
3,874,531 A * 4/1975 Mayo ..... B60D 1/00 280/47.35
3,912,350 A 10/1975 Gurubatham
4,191,436 A * 3/1980 Cherry ..... A47B 67/04 312/265.1
4,372,632 A 2/1983 Villa
4,441,770 A 4/1984 Brezosky
4,565,385 A * 1/1986 Morford ..... A61G 5/00 280/250.1

(Continued)

FOREIGN PATENT DOCUMENTS

NL 8005942 A 10/1980

OTHER PUBLICATIONS

UK IPO Combined Search and Examination Report, dated Apr. 30, 2015; 4 pages.

(Continued)

*Primary Examiner* — Hanh V Tran
(74) *Attorney, Agent, or Firm* — Seyfarth Shaw LLP

(57) ABSTRACT

A dual-bracket roll stability device is disclosed that prevents a roll cab from tipping over when the drawers of the roll cab are in a fully-extended position. A first bracket can be coupled to a side of a roll cab and a second bracket can be coupled to a bottom of the roll cab. The brackets each include portions that extend outward to contact the ground when the roll cab begins to tip. These portions are coupled together to distribute the load along the bottom and side portions of the roll cab. Accordingly, when the drawers of the roll cab are fully extended, the stability device can maintain the roll cab's balance while remaining discrete and spatially compact.

15 Claims, 6 Drawing Sheets

(56) References Cited

U.S. PATENT DOCUMENTS

| | | | | | |
|---|---|---|---|---|---|
| 4,618,191 | A * | 10/1986 | Peterman | A47B 53/02 | 104/248 |
| 4,624,511 | A | 11/1986 | Oehme | | |
| 4,770,475 | A | 9/1988 | Peterman | | |
| 4,811,999 | A | 3/1989 | Remington | | |
| 4,836,624 | A | 6/1989 | Schwickrath | | |
| 4,911,507 | A * | 3/1990 | Leist | A47B 53/02 | 312/201 |
| 5,401,076 | A * | 3/1995 | Dunlap | A47D 1/10 | 397/243 |
| 5,797,503 | A | 8/1998 | Stevens | | |
| 5,971,512 | A | 10/1999 | Swan | | |
| 6,164,738 | A | 12/2000 | Dane | | |
| 6,422,580 | B1 | 7/2002 | Hunter | | |
| 6,681,702 | B1 * | 1/2004 | Nicely | A47B 53/02 | 105/157.1 |
| 6,817,687 | B1 * | 11/2004 | Neeld | A47B 91/08 | 312/351.1 |
| 6,857,711 | B1 | 2/2005 | Straus | | |
| 7,225,903 | B2 * | 6/2007 | Nebolon | B62B 3/14 | 188/19 |
| 8,152,253 | B2 | 4/2012 | Yu | | |
| 8,267,261 | B2 | 9/2012 | Vanderhoek | | |
| 2004/0174105 | A1 | 9/2004 | Hung | | |
| 2006/0261654 | A1 * | 11/2006 | Stallman | A47C 15/004 | 297/310 |
| 2008/0271648 | A1 | 11/2008 | Baughman | | |
| 2009/0212511 | A1 | 8/2009 | Northam | | |
| 2009/0251038 | A1 | 10/2009 | Yu et al. | | |
| 2011/0115354 | A1 | 5/2011 | Blöchl | | |
| 2014/0001722 | A1 * | 1/2014 | Willey | B62B 3/02 | 280/47.35 |

OTHER PUBLICATIONS

Australian Government IP Patent Examination Report No. 1, dated Aug. 21, 2015; 7 pages.

Canadian Intellectual Property Office, Examiner's Report dated Oct. 20, 2015; 3 pages.

* cited by examiner

ROLL CAB STABILITY DEVICE

CROSS REFERENCES TO RELATED APPLICATIONS

This application claims the benefit of U.S. Provisional Patent Application Ser. No. 61/904,019, filed Nov. 14, 2013, entitled Roll Cab Stability Device, the content of which is incorporated herein by reference in its entirety.

TECHNICAL FIELD

The present application relates to a stability device for a roll cab. Particularly, the present application relates to a dual-bracket anti-tipping device that helps prevent a roll cab from tipping over.

BACKGROUND

Industry regulations require roll cabs to remain upright even when all drawers of the roll cab are fully opened. Accordingly, compliant roll cabs have some device or structure that reduces or prevents tipping of the roll cab even when the drawers are fully extended.

Current roll cabs typically include a mechanism that includes two bars that selectively extend from sides of the roll cab beyond the extended drawers. These bars maintain the roll cab in an upright position but are spatially inconvenient and present a tripping hazard. Also, the bars are not permanently outstretched and must be manually extended to perform their intended function.

SUMMARY

The present application discloses a dual-bracket roll stability device that prevents a roll cab from tipping over when the drawers of the roll cab are in a fully extended position. The two brackets may couple to a side and bottom of the roll cab (for example, using attachment points of casters that support the weight of the roll cab), respectively, to distribute the load to different portions of the roll cab during tipping. The brackets each include an extension configured to contact the ground during tipping. The two extensions may be coupled together to improve strength and load distribution. When the roll cab begins to tip, for example due to the drawers being fully extended, the stability device may reduce or prevent tipping of the roll cab or otherwise maintain the balance of the roll cab while remaining discrete and spatially compact.

The present application discloses a stability device including a first bracket having a first main body extending in a first direction, a first portion extending from the main body in a second direction, and a first extension extending from the main body in a third direction, and a second bracket having a second main body extending in the first direction, a second portion extending from the second main body, and a second extension extending from the second main body in the third direction.

The present application also discloses a roll cab including a housing, a wheel or caster coupled to a bottom of the housing, drawers capable of extending from the housing in a first direction from a closed position to a fully-extended position, and a stability device including a first bracket having a first main body extending in the first direction, a first portion extending from the main body in a second direction, a first extension extending from the main body in a third direction, and a second bracket having a second main body extending in the first direction, a second portion extending from the second main body, and a second extension extending from the second main body in a third direction, wherein the stability device is configured to prevent the roll cab from tipping over when the drawers are in a fully-extended state.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
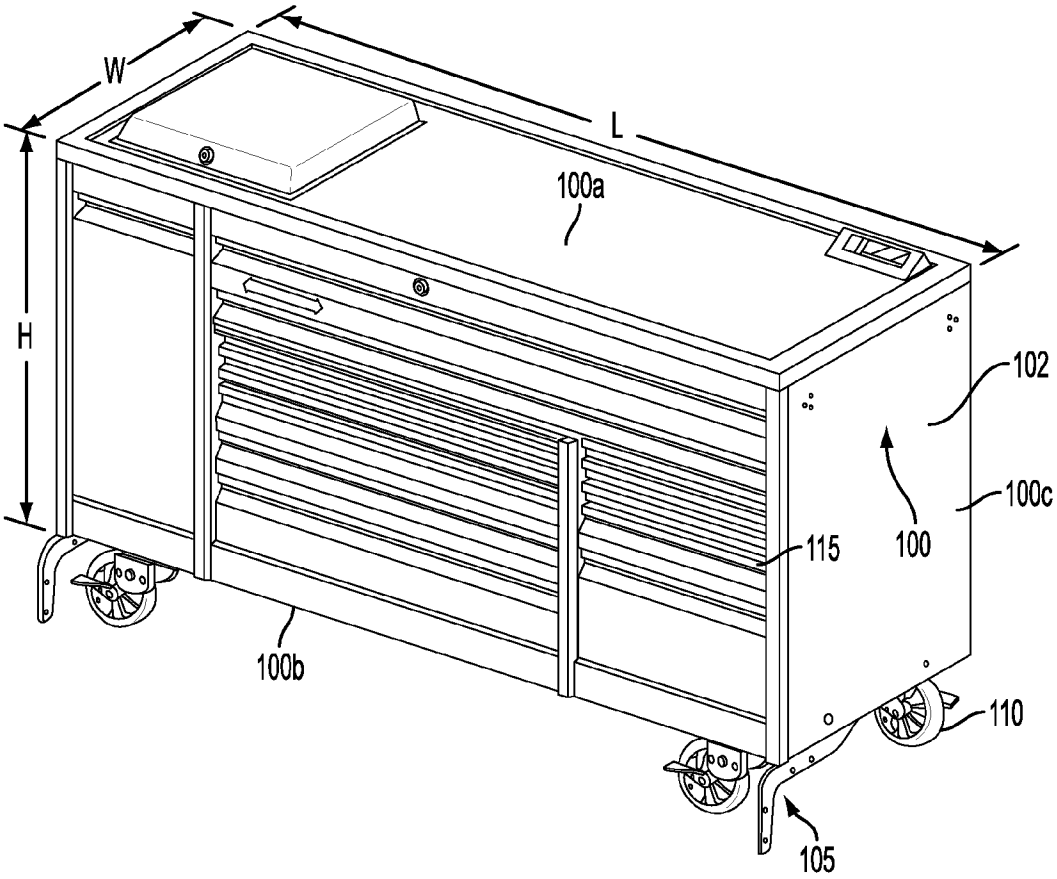
FIG. 1 is a front perspective view of a roll cab according to an embodiment of the present application.

It should be understood that the comments included in the notes as well as the materials, dimensions and tolerances discussed therein are simply proposals such that one skilled in the art would be able to modify the proposals within the scope of the present application.

DETAILED DESCRIPTION

While this disclosure is susceptible of embodiments in many different forms, there is shown in the drawings, and will herein be described in detail, certain embodiments with the understanding that the present disclosure is to be considered as an exemplification of the principles of the disclosure and is not intended to limit the broad aspect of the disclosure to embodiments illustrated.

The present application discloses a stability device that reduces or prevents tipping of a roll cab when drawers of the roll cab are in an extended position. The stability device may include two brackets—a first bracket that couples to a side of a roll cab and a second bracket that couples to a bottom of the roll cab, for example using attachment points of casters of the roll cab. The brackets each include extensions that extend outward and are configured to contact the ground when the roll cab begins to tip. The brackets may be coupled together, may distribute the load along the bottom and side portions of the roll cab when the stability device contacts the ground and may reduce or prevent tipping of the roll cab so that the roll cab maintains balance. Accordingly, when the drawers of the roll cab are extended or opened, the stability device reduces or prevents tipping of the roll cab while remaining discrete and spatially compact.

As shown in FIG. 1, the roll cab 100 may include a housing 102 having a stability device 105 and casters or wheels 110 coupled to the housing 102 at hardpoints (i.e., areas that are designed to support the weight of the roll cab 100) on a bottom portion of the roll cab 100. Drawers 115 may be provided on a front portion of the roll cab 100 and may hold, for example, tools or workpieces for a user. The drawers 115 may be disposed in a closed position, as shown, or may be disposed in a fully-extended position along internal rails (not shown), as known in the art. The drawers 115 may also be disposed in any intermediate position between the closed and fully-extended positions. The drawers 115 may be partitioned internally or may be any size and shape within dimensions of the roll cab 100. The roll cab 100 has height H, length L, and width W dimensions, a top surface 100*a* opposite a bottom surface 100*b* and a side surface(s) 100*c* perpendicular to the top surface 100*a* and the bottom surface 100*b*. For example, the bottom surface 100*b* may be defined as a surface of the roll cab 100 facing the ground, and a top surface 100*a* may be defined as a surface of the roll cab 100 opposite the bottom surface 100*b* and facing away from the ground. The side surface(s) 100*c* may include any surface of the housing 102 perpendicular to the top surface 100*a* and the bottom surface 100*b*, including a right side surface, a left side surface, a back side surface and one or more internal side surfaces.

Figure 2B:
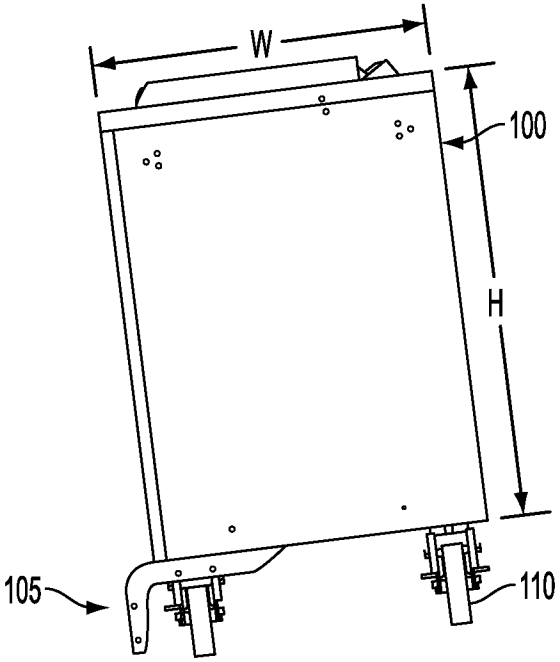
FIG. 2B is a side view of a roll cab that has tipped slightly according to an embodiment of the present application.
Figure 2A:
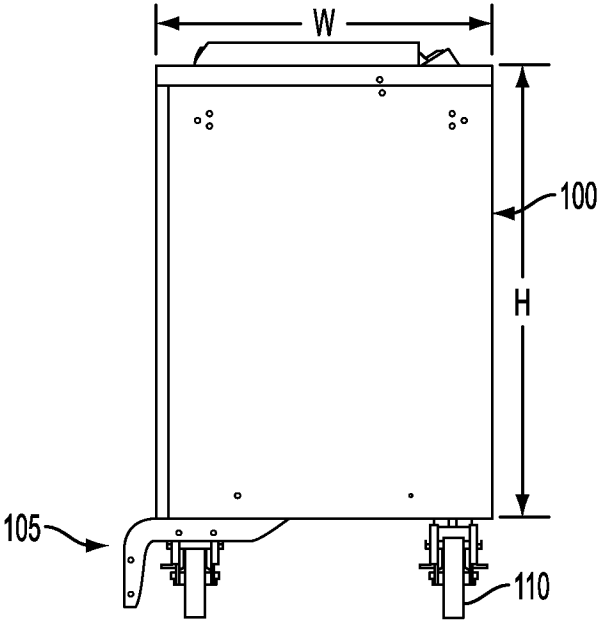
FIG. 2A is a side view of a roll cab in an upright position according to an embodiment of the present application.

The stability device 105 may be positioned on a corner of the roll cab 100 proximate a hardpoint. In some embodiments, a stability device 105 is coupled to each of the two bottom front corners proximate the wheels 110 to reduce or prevent tipping of the roll cab 100 if the drawers 115 are in the extended position, or for any other reason. For example, FIG. 2A illustrates the roll cab 100 balanced on the wheels 110 in an upright position, and the stability device 105 does not contact the ground. However, FIG. 2B illustrates the roll cab 100 tipped slightly and the stability device 105 in contact with the ground to reduce tipping or prevent the roll cab 100 from tipping completely over. In some embodiments, the stability device 105 may be coupled to the roll cab 100 by screws, bolts, fasteners or other permanent means such that the stability device 105 is always functional and cannot be disengaged unless removed completely from the stability device 105. The stability device 105 may be coupled flush against a side of the roll cab 100 to be spatially compact. However, the stability device 105 is not limited thereto and may extend from the side surface(s) 100*c* of the roll cab 100 without departing from the disclosure. The stability device 105 may be coupled to the bottom surface 100*b* using fasteners that also couple a mounting plate of the wheels 110 to the bottom surface 100*b*. Similarly, the stability device 105 may be coupled to an interior face of the exterior side surface(s) 100*c* or to side surface(s) 100*c* included in the interior of the roll cab 100 without departing from the disclosure.

Figure 3:
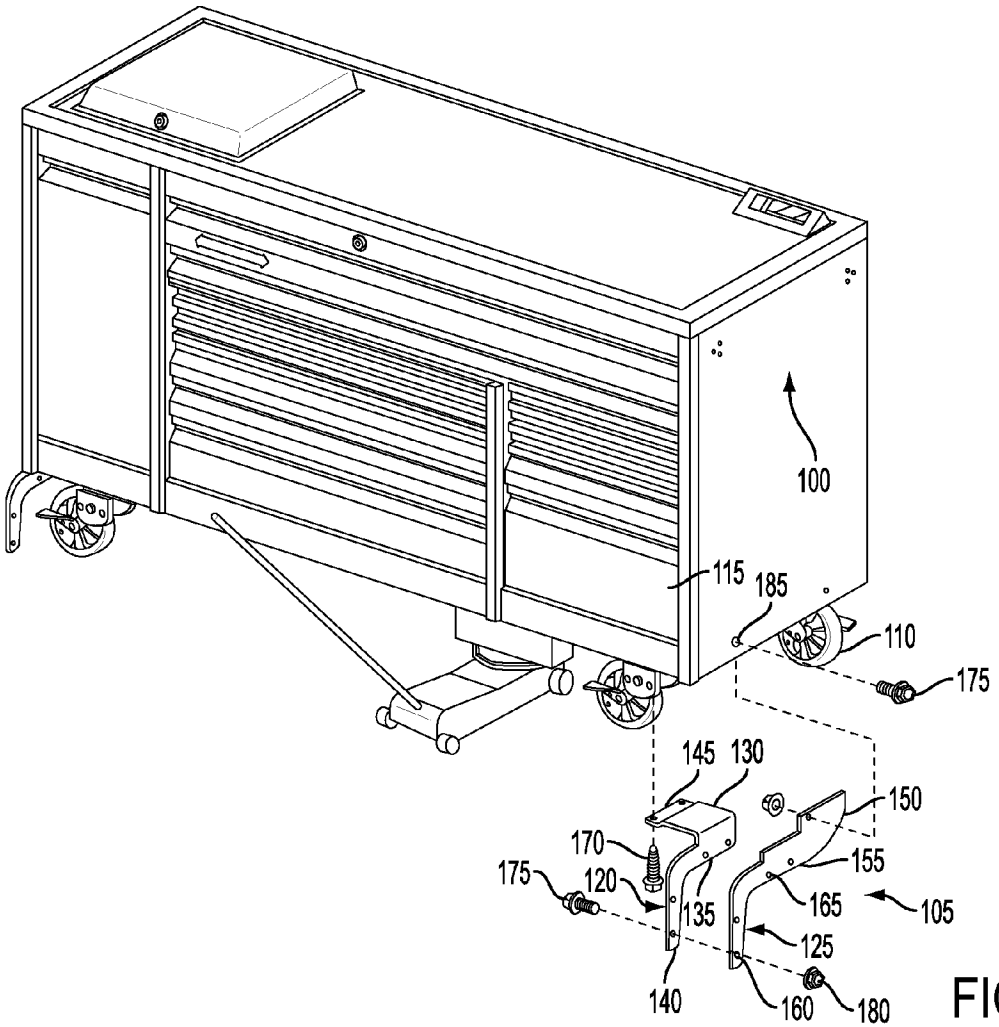
FIG. 3 is an exploded view of a stability device and roll cab according to an embodiment of the present application.
Figure 4:
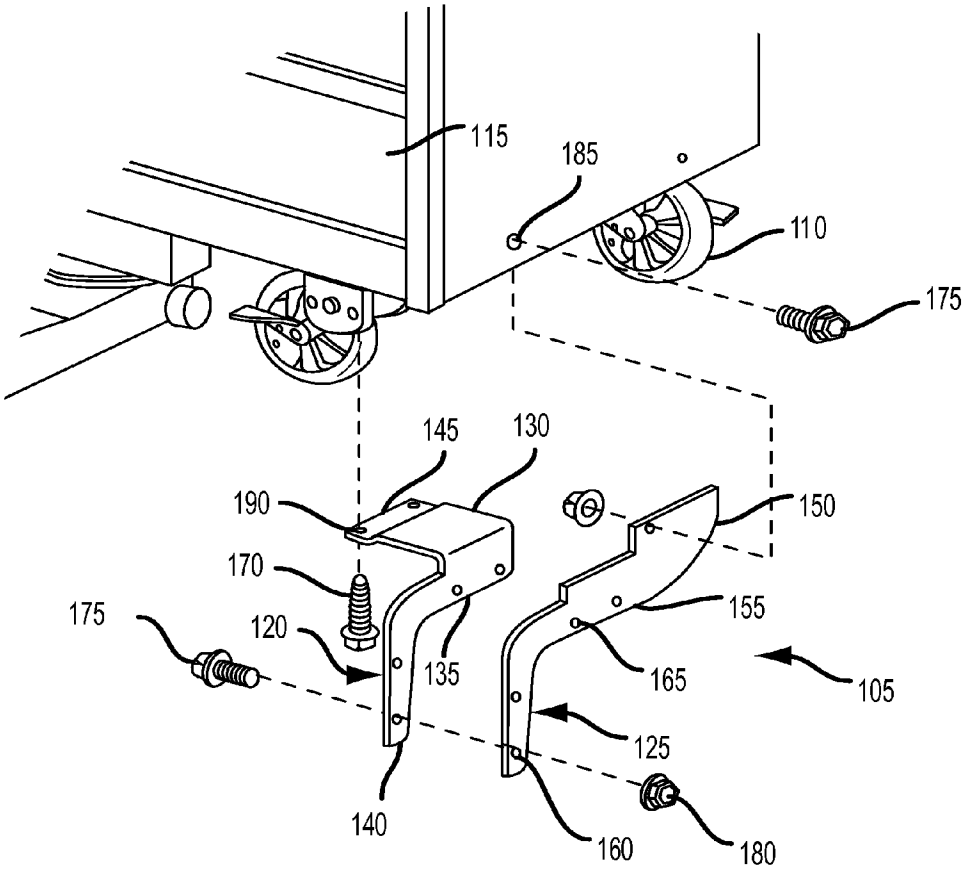
FIG. 4 is an enlarged exploded view of a portion of the stability device and roll cab of FIG. 3 according to an embodiment of the present application.

FIG. 3 illustrates an exploded view of the roll cab 100 and stability device 105, and FIG. 4 illustrated an enlarged view of a portion of FIG. 3 according to an embodiment of the present application. As shown, the stability device 105 includes a first bracket 120 and a second bracket 125 that are coupled to the bottom surface 100*b* and the side surface(s) 100*c* of the roll cab 100, respectively. The first bracket 120 may include a first main body 135 extending in a first direction, a first portion 130 extending from the first main body 135 in a second direction, and a first extension 140 extending from the first main body 135 in a third direction that is downward and away from the roll cab 100. The first direction may be in the direction of potential tipping of the roll cab 100, for example the direction that the drawers 115 extend to the fully-extended position. As an example, the first direction may be along the width of the roll cab 100, the second direction may be along the length of the roll cab 100 (perpendicular to the first direction at approximately a 90 degree angle) and the third direction may be along the height of the roll cab 100, but the disclosure is not limited thereto. The first portion 130 may be configured to couple to the bottom surface 100*b* of the roll cab 100. For example, the first bracket 120 may include a lip 145 that is configured to accommodate a mounting plate of a wheel 110 and receive screws, bolts or other fasteners, via aperture 190 or notches 195 (illustrated in FIG. 5), to couple the first bracket 120, along with the wheel 110, to the bottom surface 100*b* of the roll cab 100. The first bracket 120 may thus be positioned under and share a same hardpoint as the wheel 110.

The disclosure is not limited thereto, however, and the first bracket 120 may be configured to receive screws or other fasteners at any position along the first bracket 120. In some embodiments, at least part of the first portion 130 may be configured to lie flush against the bottom surface 100*b* of the roll cab 100. In other embodiments, at least a part of the first portion 130 may be configured to be inserted into an opening (not shown) in the bottom surface 100*b* of the roll cab 100.

The second bracket 125 may include a second main body 155 extending in the first direction and a second portion 150 extending from the second main body 155 and configured to couple to the side surface(s) 100*c* of the roll cab 100. The second portion 150 may extend in a direction opposite the third direction and may be configured to distribute a load borne by the stability device 105 to the side surface(s) 100*c* of the roll cab 100. The second bracket 125 may also include a second extension 160 that extends from the second main body 155 in the third direction, that is, downward and away from the roll cab 100. The second extension 160 may be substantially equivalent in size and shape to the first extension 140, although the disclosure is not limited thereto. In some examples, the first extension 140 and the second extension 160 may include openings 165 that may be aligned and the first extension 140 and the second extension 160 may be coupled together with fasteners such as bolts 175 and nuts 180 using the openings 165.

In some embodiments, the first extension 140 has a first extension shape that is substantially equivalent to a second extension shape of the second extension 160. The first extension 140 and the second extension 160 may be curved or angled in this manner so long as the roll cab 100 is prevented from tipping when the drawers 115 are extended. When the roll cab 100 tips, the first extension 140 and/or the second extension 160 may contact the ground and reduce or prevent tipping of the roll cab 100. Thus, the first bracket 120 and the second bracket 125 may maintain the balance of the roll cab 100 rather than allowing the roll cab 100 to tip over.

In some embodiments, the first extension 140 may extend at a first angle relative to the first main body 135 and the second extension 160 may extend at a second angle relative to the second main body 155. The first angle may be one of an acute angle, a right angle or an obtuse angle. For example, if the first angle of the first extension 140 is an acute angle relative to the first main body 135, the first angle may be less than 90 degrees and the first extension 140 may be configured to contact the ground at a point under the first main body 135 when the roll cab 100 is tilted. If the first angle of the first extension 140 is a right angle relative to the first main body 135, the first angle may be approximately 90 degrees and the first extension 140 may be configured to contact the ground at a point approximately perpendicular to a proximate end of the first main body 135 when the roll cab 100 is tilted. If the first angle of the first extension 140 is an obtuse angle relative to the first main body 135, the first angle may be greater than 90 degrees and the first extension 140 may be configured to contact the ground at a point away from the first main body 135 when the roll cab 100 is tilted.

The second angle may be one of an acute angle, a right angle or an obtuse angle and may be identical to or different from the first angle. For example, both the first angle and the second angles may be acute, right, or obtuse angles and the first extension 140 and the second extension 160 may be substantially equivalent in size and shape, as described above. As an alternative, the first angle of the first extension 140 may be an obtuse angle relative to the first main body 135 while the second angle of the second extension 160 may be one of a different obtuse angle or a right angle relative to the second main body 155. In this example, the first extension 140 may be configured to contact the ground prior to the second extension 160 when the roll cab 100 is tilted, although the disclosure is not limited thereto. For example, a length of the first extension 140 may be different than a length of the second extension 160 and the first extension 140 and the second extension 160 may be configured to contact the ground at approximately the same time when the roll cab 100 is tilted.

The first extension 140 and the second extension 160 may be disposed and/or extend beyond a footprint of the roll cab 100, as illustrated in FIGS. 2A and 2B. However, the disclosure is not limited thereto and the first extension 140 and the second extension 160 may extend to an edge of the footprint of the roll cab 100 without extending beyond the footprint. Alternatively, the first extension 140 and the second extension 160 may be disposed within the footprint of the roll cab 100 provided that the first extension 140 and the second extension 160 are disposed between the wheels 110 and an edge of the footprint.

In these examples, the first extension 140 and the second extension 160 may include one or more openings 165 that may be aligned and the first extension 140 and the second extension 160 may be configured to be coupled together, although the disclosure is not limited thereto. For example, a portion of the first extension 140 proximate to the first main body 135 may be configured to be coupled to a portion of the second extension 160 proximate to the second main body 155, with the remainder of the first extension 140 uncoupled to the remainder of the second extension 160. In some embodiments, the first main body 135 and the second main body 155 may be coupled while the entirety of the first extension 140 and the second extension 160 may be uncoupled.

The first bracket 120 and the second bracket 125 may be coupled to the roll cab 100 with fasteners such as screws 170 through the openings 165. The first bracket 120 and the second bracket 125 may also be coupled together with fasteners such as bolts 175 and nuts 180. In some embodiments, the roll cab 100 may include threaded openings 185 to receive fasteners and couple the first bracket 120 and/or the second bracket 125 to the roll cab 100. The first bracket 120 may be coupled to the bottom surface 100*b* of the roll cab 100, and the second bracket 125 may be coupled to the side surface(s) 100*c* of the roll cab 100. Accordingly, when the roll cab 100 tips, the load borne by the stability device 105 is distributed to both the side and bottom of the roll cab 100. Distributing the load in this manner avoids the load being focused on one area of the roll cab 100, which could cause failure after repeated loads.

Figure 5:
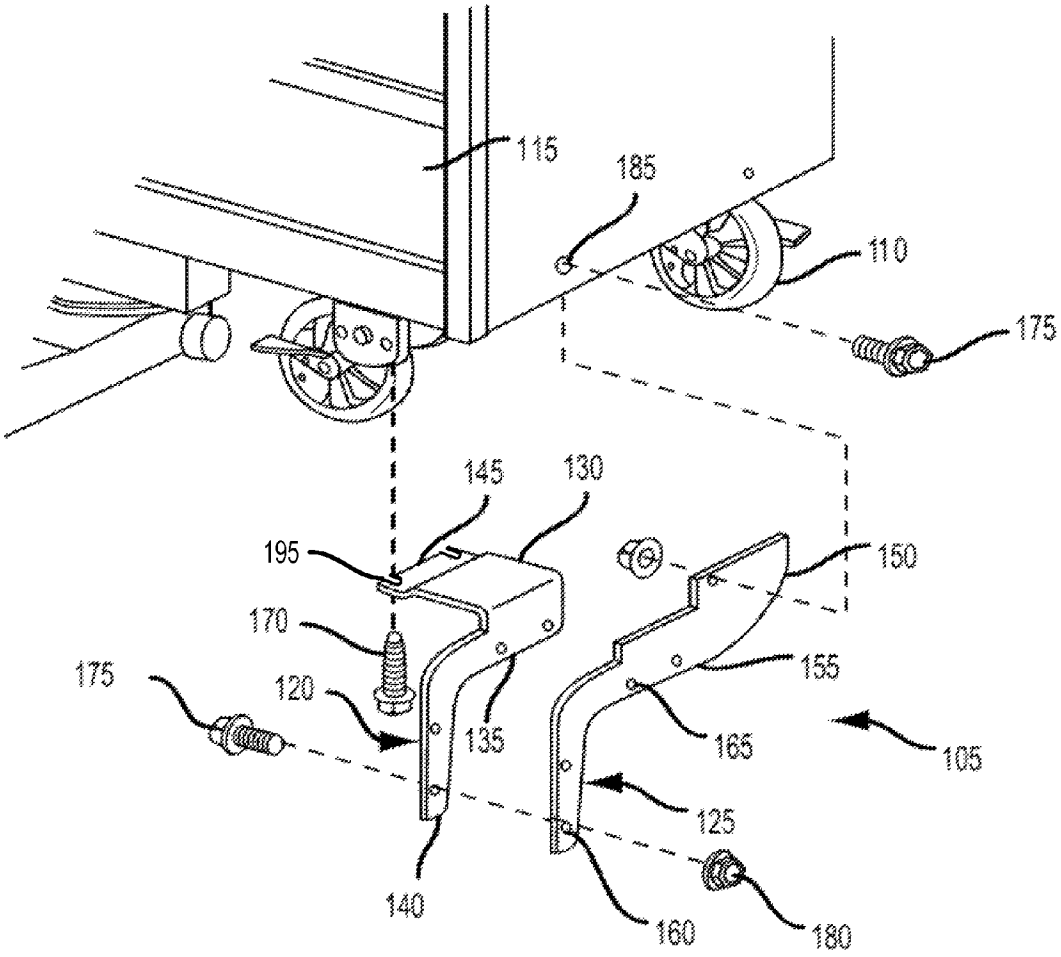
FIG. 5 is another enlarged exploded view of a portion of a stability device and roll cab according to an embodiment of the present application.

Referring to FIGS. 4 and 5, the first bracket 120 and the second bracket 125 may be coupled to the roll cab 100 using the following method. The wheel 110 proximate a front of the roll cab 100 may be removed (for example, by removing fasteners coupling the wheel 110 to the bottom surface 100*b* of the roll cab 100) and rotated to reverse the orientation of the wheel 110 (for example rotated about 180°). This causes a swivel locking pin (not shown) of the wheel 110 to face inboard (away from the side surface 100*c*). The first bracket 120 (as illustrated in FIG. 4) may then be aligned with the mounting plate of the wheel 110. For example, the apertures 190 may be aligned with apertures of the mounting plate of the wheel 110. The fasteners 170 may then be installed through the respective apertures 190 and the respective apertures of the mounting plate of the wheel 110 to couple the first bracket 120 and the wheel 110 to the bottom surface 100*b* of the roll cab 100. The lip 145 of the first bracket 120 is offset with respect to the first portion 130 and accommodates the mounting plate of the wheel 100.

In another embodiment, the wheel 110 may be removed, rotated to reverse the orientation of the wheel 110, and reinstalled to the bottom surface 100*b* (using fasteners 170). The fasteners 170 may then be loosened, and the notches 195 of the first bracket 120 (as illustrated in FIG. 5) may then be slid onto the fasteners 170. The fasteners 170 may then be tightened to couple the first bracket 120 and the wheel 110 to the bottom surface 100*b* of the roll cab 100. As described above, the lip 145 of the first bracket 120 is offset with respect to the first portion 130 and accommodates the mounting plate of the wheel 100.

Referring to FIGS. 4 and 5, the second bracket 125 may be coupled to an internal side of the side surface 100*c* by fasteners 175 using opening 185. The first bracket 120 and the second bracket 125 are aligned such that openings 165 align and coupled together by fasteners, such as bolts 175 and nuts 180 using the openings 165. This may be repeated to install a second stability device 105 on the other side of the roll cab 100.

The wheels 110 are typically located at hardpoints to allow the wheels 110 to carry the load of the roll cab 100. In an embodiment, the stability device 105 is configured to couple to the bottom surface 100*b* using an existing attachment point of a wheel 110. Thus, the stability device 105 may share a hardpoint of the wheel 110. This allows the stability device 105 to distribute load when the roll cab 100 tips to a hardpoint, thereby reducing to potential for compromising the structural integrity of the roll cab 100 when the roll cab 100 tips.

Figure 6:
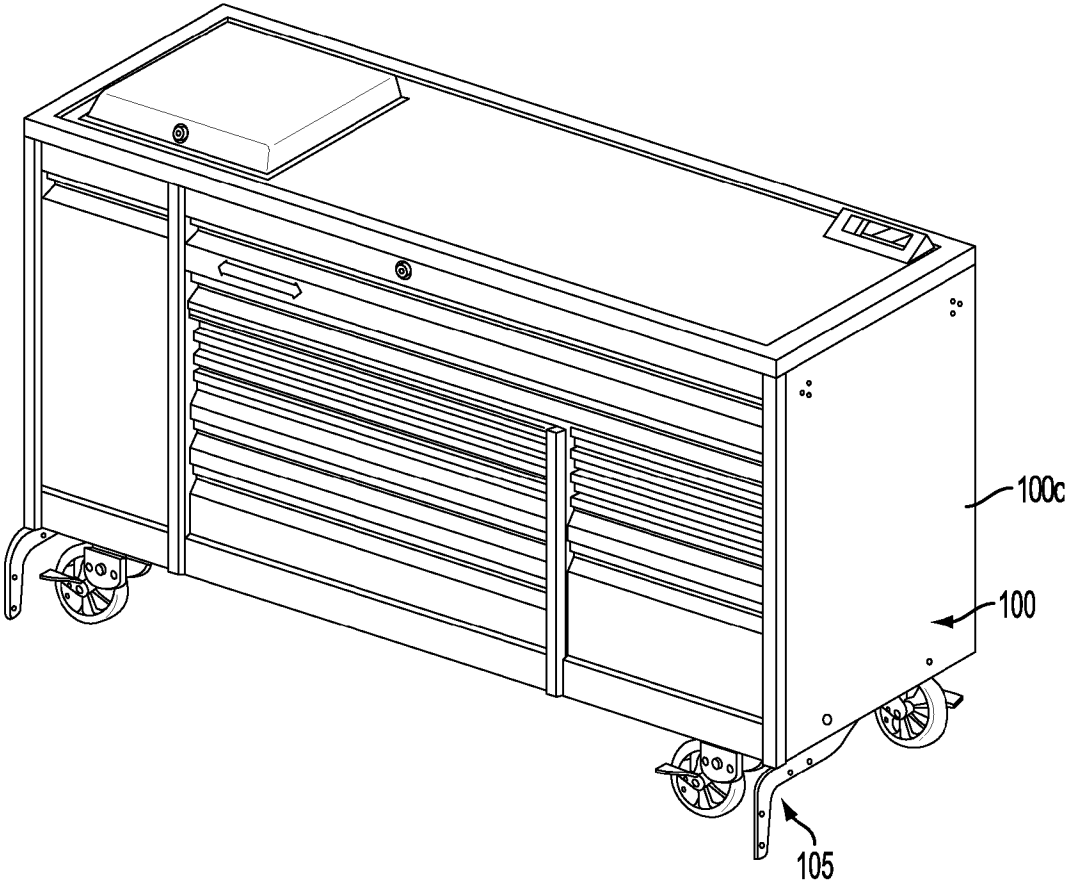
FIG. 6 is a front perspective view of a stability device coupled to the roll cab according to an embodiment of the present application.

As shown in FIG. 6, the stability device 105 may be coupled to side surface(s) 100*c* of the roll cab 100 within an internal slot positioned proximate to the side surface(s) 100*c*. For example, the stability device 105 may be coupled to an interior face of the exterior side surface(s) 100*c* or to side surface(s) 100*c* included in the interior of the roll cab 100. The stability device 105 may therefore be positioned flush against the roll cab 100 side surface(s) 100*c* or even within the roll cab 100, avoiding a potential obstruction extending from the side surface(s) 100*c* of the roll cab 100 in a lengthwise direction. This configuration provides a spatially compact design and allows the roll cab 100 to be positioned against a wall or another roll cab, or any other device or structure, with little or no spacing therebetween. The stability device 105 may extend from the roll cab 100 in a widthwise direction, as illustrated in FIG. 6. However, the stability device 105 may be disposed within the footprint of the roll cab 100 provided that the first extension 140 and the second extension 160 of the stability device 105 are disposed between the wheels 110 and an edge of the footprint.

As opposed to prior art stability devices, the stability device 105 of the present application is coupled to the roll cab 100 with fasteners that prevent disengagement of the stability device 105 absent complete removal of the stability device 105. The stability device 105 therefore functions as needed and without requiring a user to retract and activate the stability device 105, as with certain prior art stability devices. The roll cab 100 may therefore have a latent anti-tipping ability with the stability device 105 installed.

In some embodiments, two or more stability devices 105 may be disposed along a front face of the roll cab 100, that is, the face in which the drawers 115 are located. For example, the stability devices 105 may be disposed at the corners of the bottom surface 100*b* and the exterior side surface(s) 100*c*. Alternately, the stability devices 105 may be provided along an edge coupling the corners of the bottom surface 100*b* and the side surface(s) 100*c*. Further, in addition to the stability devices 105 disposed in proximity to the exterior side surface (s) 100*c*, one or more stability devices 105 may be disposed along an interior of the roll cab 100 in proximity to interior side surface(s) 100*c*. Any other number or location of stability devices 105 may be implemented without departing from the spirit and scope of the present application.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A stability device for a structure comprising:

a first bracket configured to couple to a bottom of the structure and including:

a first main body extending in a first direction;

a first portion extending from the first main body in a second direction;

a first extension extending from the first main body in a third direction; and a second bracket configured to fixedly couple to the first bracket and to a side of the structure, the second bracket including:

a second main body extending in the first direction; and a second extension extending from the second main body in the third direction, wherein at least part of a first extension shape of the first extension substantially corresponds to at least part of a second extension shape of the second extension, the first and second extension shapes respectively including first and second planar portions fixedly coupled flush against one another.

2. The stability device of claim 1, wherein the first bracket is coupled to a hardpoint of the bottom of the structure.

3. The stability device of claim 2, wherein the first and second brackets each has openings configured to respectively receive fasteners to couple the first bracket to the second bracket.

4. The stability device of claim 1, wherein the first main body is coupled to the second main body.

5. The stability device of claim 1, wherein the first bracket includes a lip extending from the first portion and includes openings, the lip configured to accommodate a mounting plate of a wheel of the structure, and the openings are configured to respectively receive fasteners to couple the first bracket to the bottom of the structure.

6. The stability device of claim 1, wherein the first direction is substantially along a horizontal axis, the second direction is substantially along a vertical axis, and the third direction is substantially along a lateral axis.

7. The stability device of claim 1, wherein the first extension extends at a first angle relative to the first main body and the second extension extends at a second angle relative to the second main body.

8. The stability device of claim 7, wherein the first and second angles are obtuse angles relative to the first main body and the second main body, respectively.

9. The stability device of claim 7, wherein the first angle is different than the second angle.

10. A roll cab including a housing with a side and a bottom having a wheel and drawers configured to extend from the housing in a first direction from a closed state to an opened state, comprising:

a stability device including:

a first bracket coupled to the bottom and including:

a first main body extending in the first direction;

a first portion extending from the main body in a second direction;

a first extension extending from the first main body in a third direction; and a second bracket fixedly coupled to the first bracket and to the side of the housing, including:

a second main body extending in the first direction; and a second extension extending from the second main body in the third direction, wherein at least part of a first extension shape of the first extension substantially corresponds to at least part of a second extension shape of the second extension, the first and second extension shapes respectively include first and second planar portions fixedly coupled flush against one another.

11. The roll cab of claim 10, wherein the first bracket is coupled to a hardpoint of the bottom.

12. The roll cab of claim 11, wherein the first and second brackets each has openings configured to respectively receive fasteners to couple the first bracket to the second bracket.

13. The roll cab of claim 11, wherein the first main body is coupled to the second main body.

14. The roll cab of claim 10, wherein the first bracket includes a lip extending from the first portion and openings, the lip configured to accommodate a mounting plate of the wheel, and the openings are configured to respectively receive fasteners to couple the first bracket and the wheel to the bottom.

15. The roll cab of claim 10, wherein the first direction is substantially along a width of the roll cab, the second direction is substantially along a length of the roll cab, and the third direction is substantially along a height of the roll cab.

* * * * *